US008539941B2

(12) United States Patent
Iwamoto et al.

(10) Patent No.: US 8,539,941 B2
(45) Date of Patent: Sep. 24, 2013

(54) BUILT-IN COOKING DEVICE

(76) Inventors: Masayuki Iwamoto, Osaka (JP); Tatsuhiko Nakamura, Osaka (JP)

( * ) Notice: Subject to any disclaimer, the term of this patent is extended or adjusted under 35 U.S.C. 154(b) by 424 days.

(21) Appl. No.: 12/700,239

(22) Filed: Feb. 4, 2010

(65) Prior Publication Data

US 2010/0199966 A1 Aug. 12, 2010

(30) Foreign Application Priority Data

Feb. 6, 2009 (JP) ..... 2009-025811

(51) Int. Cl.
*F24C 15/02* (2006.01)
*H05B 6/80* (2006.01)

(52) U.S. Cl.
USPC .... 126/21 R; 126/299 R; 126/198; 126/21 A; 219/757; 219/681; 219/756

(58) Field of Classification Search
USPC ..... 126/21 R, 21 A, 273 R, 299 R; 219/400, 219/757, 681, 756
See application file for complete search history.

(56) References Cited

U.S. PATENT DOCUMENTS

| | | | | |
|---|---|---|---|---|
| 4,354,084 | A * | 10/1982 | Husslein et al. | 219/757 |
| 4,418,261 | A * | 11/1983 | Jailor et al. | 219/757 |
| 4,592,333 | A * | 6/1986 | Dustin | 126/21 R |
| 4,796,600 | A * | 1/1989 | Hurley et al. | 126/273 A |
| 6,528,774 | B2 * | 3/2003 | Lee | 219/757 |
| 6,913,012 | B2 * | 7/2005 | Divett et al. | 126/21 A |
| 7,180,041 | B2 * | 2/2007 | Song et al. | 219/757 |
| 7,537,003 | B2 * | 5/2009 | Iwamoto | 126/299 R |
| 2006/0219234 | A1 * | 10/2006 | Larsen | 126/198 |
| 2008/0105140 | A1 * | 5/2008 | Lee et al. | 99/468 |
| 2008/0184985 | A1 * | 8/2008 | Hasslberger et al. | 126/21 R |
| 2008/0264933 | A1 * | 10/2008 | Jeong | 219/679 |
| 2010/0187225 | A1 * | 7/2010 | Park | 219/757 |

FOREIGN PATENT DOCUMENTS

| | | |
|---|---|---|
| JP | 48-80128-01 | 12/1947 |
| JP | 55-175992 | 6/1954 |
| JP | 09-229377 A | 9/1997 |

(Continued)

OTHER PUBLICATIONS

Japanese Office Action dated Aug. 28, 2012.

*Primary Examiner* — Kang Hu
*Assistant Examiner* — Nikhil Mashruwala
(74) *Attorney, Agent, or Firm* — Birch, Stewart, Kolasch & Birch, LLP

(57) ABSTRACT

The invention provides a drawer type built-in cooking device, wherein an air outlet portion 10 for discharging the inside air containing heat and vapor generated during cooking of an object to be cooked has an air outlet duct 11 communicated from an air outlet port area 3*b* formed on a side wall of the heating chamber 3 to a lower side portion of a front wall 1*a* of the cooking device body 1. The outlet air flow flowing through the air outlet duct 11 is sent downward from an air outlet opening 13 formed to a lower side portion of the front wall 1*a* of the cooking device body 1 and discharged to the exterior of the device. The present invention enables to eliminate the prior art air inlet and outlet duct structure disposed below the heating chamber 3, and therefore, the height of the heating chamber can be increased correspondingly. Further, the air outlet opening 13 is hidden from the exterior without having to attach a louver since the opening is covered by a door 2*a* when the door is closed, so that the exterior design thereof is improved.

10 Claims, 8 Drawing Sheets

(56) References Cited

FOREIGN PATENT DOCUMENTS

| | | | |
|---|---|---|---|
| JP | 2002-228163 | A | 8/2002 |
| JP | 2003-343855 | A | 12/2003 |
| JP | 2005-172388 | A | 6/2005 |
| JP | 2005-221081 | A | 8/2005 |
| JP | 2006-223337 | A | 8/2006 |

* cited by examiner

BUILT-IN COOKING DEVICE

The present application is based on and claims priority of Japanese patent application No. 2009-025811 filed on Feb. 6, 2009, the entire contents of which are hereby incorporated by reference.

BACKGROUND OF THE INVENTION

1. Field of the Invention

The present invention relates to a cooking device in general, and especially relates to a built-in cooking device having a drawer body capable of storing therein an object to be cooked, and movably disposed within a cooking device body to be drawn out therefrom.

2. Description of the Related Art

A large number of cooking devices such as microwave ovens with an open/close door disposed on a front side thereof have been proposed, but on the other hand, another type of cooking device having a drawer that can be drawn out to the front side of the device has also been proposed. The drawer type cooking device can suitably be applied to relatively large-scale structures, so that it is considered as a cooking device constituting a part of a fitted kitchen or a designed kitchen. Reflecting the recent systemization and increase in size of kitchens, cooking devices have also been diversified and unitized, and various cooking devices being combined with cook tops, drawer-type microwave ovens, electric ovens and so on and built into kitchens are proposed.

The present applicant has proposed a drawer type cooking device having a cooking device body including a heating chamber, a drawer body disposed movably within the cooking device body 1 so as to be drawn out from within the heating chamber of the cooking device body, and a slide mechanism composed of a slide rail for moving the drawer body within the cooking device body, wherein the slide mechanism is disposed outside the heating chamber (patent document 1: Japanese patent application laid-open publication No. 2005-221081). According to the drawer type cooking device, the loading portion for loading an object to be heated in the heating chamber can be drawn out together with the door, so as to eliminate the need to form the slide mechanism using components or materials having high heat resistance and flame resistance, and to prevent the occurrence of microwave discharge failure caused by microwave.

Traditional cooking devices on countertop are almost without exception supplied with air inlet and outlet over back panel and side panels of the outer cabinet, taking in air through air inlet for the purpose of cooling electrical components and others, and discharging through air outlet hot air with vapor emitting from foods cooked to be scattered into the thin kitchen air. Such configuration in design to place such air inlet and outlet over insignificant areas of the cabinet to counterpart inner configurations requires only ordinary engineering skills and practices.

On the other hand, built-in cooking devices, especially such as shown in the present applicant's patent document 1 above, are allowed to take in and discharge air only by way of limited square inches that could be spared apparently on the front surface, forcing severe restrictions on specialists in the trade to decide upon cooking device configurations. Based on such restrictions arising from majoring in built-in construction, the present applicant has proposed a drawer type cooking device as a built-in kitchen equipment to be built into a cabinet, wherein an air inlet portion and an air outlet portion are collectively disposed on a lower end portion on the front side of the device to thereby improve the efficiency of intake and discharge of air, improve the efficiency of cooling electric components and discharge of inside air, and to relieve the limitations of design and arrangement of the cooking device (patent document 2: Japanese patent application laid-open publication No. 2006-223337).

The concept of air flow according to the air inlet and outlet system according to the above-mentioned drawer type cooking device is as illustrated in FIG. 9. Further, FIGS. 10A and 10B show the arrangement of electric components at a depth portion of the prior art built-in cooking device, wherein FIG. 10A is a right side view and FIG. 10B is a rear view thereof. A louver for air inlet and outlet grill is disposed to cover the whole width of the cooking device body 51 at the lower front side portion of the cooking device body 51, wherein the left end portion of the front side air inlet and outlet grill is formed as an air inlet port 63. A lower side portion 59 arranged below the heating chamber 53 of the cooking device body 51 constitutes a bottom surface air inlet and outlet duct structure, wherein the left end portion of the bottom surface air inlet and outlet duct corresponding to the front side air inlet port 63 is formed as an air inlet portion 60. When a cooling fan 56 within the electric component chamber disposed at a rear portion of the cooking device body 51 is activated, cooling air F1 is taken in via the front side air inlet port 63 through the air inlet portion 60, reaches a depth portion chamber at a rear side of a depth wall of the heating chamber 53 of the cooking device body 1, and is further blown into the interior of the cooking device body 51 by the cooling fan 56.

One portion of the blow out air flow (air flow F3) from the cooling fan cools an electric component (magnetron 54), and then flows through an opening portion formed on the depth wall surface of the heating chamber 53 into the heating chamber 53 (F5), passes the interior of the heating chamber 53, and then flows through an opening portion disposed on the front side of the heating chamber into a ceiling panel air outlet duct 66 (F6). The ceiling panel air outlet duct 66 is laid horizontally toward the depth of the product on the outer side of the ceiling panel of the heating chamber (first portion 66*a*), and at the portion where the heating chamber ceiling panel is ended, it is bent toward the right and laid horizontally (second portion 66*b*), and then at the right end of the heating chamber, it is laid to bend down perpendicularly to enable air to flow into a vertical duct 67 disposed on the right end (F7 through F9). The discharged air is finally passed through an air outlet duct 61 on the right end of the bottom surface air inlet and outlet duct, and blows out to the exterior through the right end air outlet port 64 of the front side air inlet and outlet grill (F10, F11). The other air flow F4 from the cooling fan cools the electric component (high pressure transformer 55) disposed within the electric component chamber (F12), passes through the air outlet duct 62 disposed at the center of the bottom surface air inlet and outlet duct, and is discharged to the exterior through the center air outlet port 65 of the front inlet and outlet grill (F13, F14).

It is essentially rational to discharge the hot outlet air flow from the upper area of the cooking device, but since the air will be discharged toward the user, such arrangement cannot be adopted in practice. Further, if the air is discharged through a louver disposed on the lower portion of the cooking device, the hot outlet air flow will be blown out toward the user's legs. Therefore, the prior art drawer type cooking device proposes an arrangement in which an air outlet duct with a louver is disposed independently from the door, which requires an independent area for inlet air and outlet air to be formed within the limited height of the device.

However, according to the above-mentioned drawer type cooking device, the air outlet path becomes long, and the duct structure, especially the duct structure passing through the interior of the heating chamber, becomes complex and the flow path resistance is increased, and as a result, a cooling fan having a high air blow performance is required, by which the product costs and operation costs of the cooling fan are increased. Further, built-in devices must be placed in limited setting spaces having restricted heights, but since the lower duct and the louver portion take up a certain height, the height of the inner space of the cooking device had to be sacrificed corresponding to the height for ensuring independent inlet and outlet area.

Patent document 3 (Japanese patent application laid-open publication No. 2002-228163) discloses an attachment panel for a cooking device, comprising forming air blow spaces on the upper portion and the lower portion of the microwave oven being built into a closed space in a furniture instead of being placed on a counter top, forming an air inlet and outlet opening on a front side of the air blow space, and using a build-in kit for taking in air from and discharging air into the closed space, wherein the air discharged from the lower portion of the front side of the oven is directed downward so as to prevent hot air from blowing directly toward the body of the user.

If the air inlet and the air outlet of the microwave oven are separated into upper and lower areas, the object of preventing hot air from blowing toward the user can be achieved simply by directing the outlet air to flow downward. However, when air is taken in and discharged from adjacent portions on the lower area of the front side, a problem occurs in which the discharged hot air is sucked in through the air inlet and causes short circuit. Therefore, it is not only necessary to improve the arrangement of the attachment panel of the cooking device but to set the air blow speed of the outlet air, and to improve the arrangements of the inlet port and the outlet port.

Based on the trend in the field of interior designs, more and more users are putting weight on coordinating the whole kitchen with unified interior design. In the field of drawer type microwave ovens as an example of drawer type cooking devices, the drawer type microwave ovens are not subjected to price competition, but instead, are required to have high added values, so that the design thereof is required to satisfy the design expectations of the users, and that the specifications regarding performance and structure thereof must be high so as not to disappoint the high expectations of the users. Regarding physical structural conditions, the heating chamber shape of the cooking device must satisfy smooth heating and cooking operations of food and drinks preferred by the user, and the ceiling height of the heating chamber must be high enough to easily store ready-made containers and mug cups offered by various fast food shops and coffee shops. As for the size of the bottom surface of the heating chamber, in Japan, the cooking device must be large enough to store packed lunches sold in supermarkets, convenience stores and dedicated shops, whereas in the United States, the cooking device must be large enough to store at least a pizza box soled in famous pizza shops.

The present applicant has won the position of providing the one-of-a-kind microwave oven built into kitchens, since the present applicant had overcome the challenge according to the prior art and enabled the drawer type cooking device to be built into a cabinet, so it faces a new challenge of realizing higher performance and improved arrangement. As for the size of the heating chamber, the most important design challenge is to be familiar with the size demands of the users and to ensure the minimum allowable heating chamber size. In the case of built-in kitchen equipment, the installation height of the cooking device is normally within the height range from the waist to the knees of a user, and the air outlet height for discharging the warm air containing the vapor generated during cooking is set to heights corresponding to installation conditions.

As for the front-side design observed from the front side of the drawer type cooking device, the prior art devices having visible louvers are not attractive, and devices having simple, high-quality designs are desired. Louvers enable air to flow in the front-rear directions while hiding the structure on the rear side from the view of the users, and it is a function component having a plurality of louver boards extending in the horizontal direction, but it not only increases manufacturing costs, but also causes deterioration of the exterior design by the warpage of the louver boards during injection molding. Further, louver boards deteriorate the external appearance of the drawer type cooking devices and cause mismatch with the interior design of the kitchen, such as since during actual use of the product, the dust contained in the inlet air flow is collected at the front end of the louver boards, but the space between louver boards are too narrow to clean.

The problem to be solved according to the drawer type built-in cooking device is to change the air outlet structure for discharging the inside air containing heat and vapor generated during cooking of the object being heated to the exterior, and to reduce the necessary height of the air inlet and outlet structure as much as possible.

The object of the present invention is to devise the air outlet structure so as to reduce the height required for the air outlet duct and to ensure the height of the heating chamber, to thereby provide a drawer type cooking device with an attractive external appearance.

SUMMARY OF THE INVENTION

The present invention aims at solving the problems of the prior art by providing a built-in cooking device comprising a cooking device body built into a cabinet and having in an interior thereof a heating chamber capable of storing an object to be cooked, a door capable of closing a front side opening of the heating chamber, and an air outlet portion for discharging an inside air having been sent into the heating chamber and containing heat and vapor generated during cooking of the object to be cooked, wherein the air outlet portion has an air outlet duct connected to a side wall of the heating chamber and a lower side portion of a front wall of the cooking device body.

According to the present built-in cooking device, the air outlet portion for discharging the inside air containing heat and vapor generated during cooking of the object comprises an air outlet duct communicated to a side wall of the heating chamber and a lower side portion of a front wall of the cooking device body, so that the outlet air flow guided to the outside of the side wall of the heating chamber flows along the outer side of the side wall of the heating chamber and discharged to the exterior of the device through an opening formed to the lower side portion of the front wall of the cooking device body. As described, since a path through which outlet air flows is formed outside of the side wall of the heating chamber by utilizing the clearance between components of the cooking device, it is no longer necessary to form an air outlet duct structure below the heating chamber, which had been necessary according to the prior art.

Similarly, since a path through which intake air flows is formed outside of the side wall of the heating chamber by using the clearance between components of the cooking device, it is no longer necessary to form an air inlet duct structure below the heating chamber.

As described, since the present invention forms paths through which inlet air and outlet air flows by utilizing the clearance between components disposed on the outer side of the side wall of the heating chamber by changing the shapes and arrangements of components disposed on the outer side of the side wall of the heating chamber without changing the overall external size of the cooking device body and the external size of the heating chamber, it becomes possible to increase the height of the heating chamber for a height corresponding to the thickness of the eliminated inlet and outlet duct.

According to the present built-in cooking device, the side wall of the heating chamber has an air outlet port area in which a large number of air outlet ports are formed at an upper front portion of the side wall, and the air outlet duct is extended from an outer surface side of the air outlet port area along an outer surface of the side wall to the lower side portion of the front wall of the cooking device body. Since the inside air within the heating chamber has a high temperature, it tends to be gathered at the upper portion of the chamber. Therefore, such inside air is passed through the multiple air outlet ports to the exterior of the heating chamber at the air outlet port area formed at the upper front side of the side wall, then guided downward through the air outlet duct formed by utilizing the side wall of the heating chamber, to reach the lower side portion of the front wall of the cooking device body.

Further according to the present built-in cooking device, an air outlet opening of the air outlet duct is formed on the lower side portion of the front wall of the cooking device body, and the air outlet opening is hidden by the door when seeing the door from a front side thereof while the door is at a state closing the front opening of the heating chamber. As described, since the air outlet opening of the air outlet duct formed on the lower side portion of the front side of the cooking device body is hidden from the front side via the door in the state of closing the opening on the front side of the heating chamber, a visible air outlet port such as a louver disposed according to the prior art cooking device is not visible from the front side, so that the present built-in cooking device has an attractive external appearance with superior design.

Further according to the present built-in cooking device, the air outlet opening of the air outlet duct can be disposed close to a left or right end portion in the width direction of the cooking device body. The flow of inside air within the heating chamber flows toward the air outlet port area formed on one of the side walls of the device, so that the air outlet opening of the air outlet duct can be formed only on one end in the width direction of the device corresponding to the side of the air outlet.

Further according to the built-in cooking device, an air outlet portion opening at a lower end edge of a door frame is formed at an inner side of the door in an area corresponding to the air outlet opening of the air outlet duct. By adopting a door frame that also functions as the air outlet portion, it becomes possible to eliminate air inlet and outlet louvers that had been disposed on the lower front side of the prior art cooking device body formed by disposing multiple louver boards in the horizontal direction with the aim to hide the inner side while allowing air to pass therethrough, and to cut down the cost of the device.

Further according to the present drawer type built-in cooking device, a partition portion for guiding an outlet air flow from the air outlet opening of the air outlet duct corresponding to left and right boundaries of the air outlet opening of the air outlet duct is formed at an inner side of the door. By adopting such partition portion, the outlet air flow from the air outlet opening of the outlet duct can be guided preferably downward along the partition portion, so that it becomes possible to prevent hot outlet air flow from directly blowing toward the user. Further, since discharged hot air is guided downward via the partition portion, the problem of short circuit caused by having hot air sucked into the air inlet port can be solved.

According to the built-in drawer type cooking device of the present invention, air inlet and outlet ducts for discharging the inside air of the heating chamber is formed within the cooking device body, so that the independent air inlet and outlet structure disposed on the bottom portion of the prior art built-in cooking device can be eliminated, making it possible to reduce the number of components, cut down the costs, and down-size the duct structure. Further, the present invention no longer requires reinforcing the structure of the area in which inner components are mounted, that had been necessary according to the prior art air inlet and outlet structure since the elasticity thereof had amplified the impact applied thereto in the perpendicular direction. Furthermore, since the air inlet and outlet portion is hidden behind the rear side of the door, the front side external appearance of the device is simplified, enabling the device to have superior independent design and superior design matching the interior design of the whole kitchen. Since the height that had been occupied according to the prior art by the air inlet and outlet structure can now be used to increase the inner height of the heating chamber, it becomes possible to even place mug cups having a significant height in the interior of the heating chamber. Moreover, since the path length of the air outlet duct is shortened, it becomes possible to downsize the air blow fan motor and to thereby cut down the related costs. Even further, since the inside air of the heating chamber can be discharged through a duct formed using the inner wall of the chamber, the present invention enables to prevent the outlet air (vapor) from being cooled rapidly by passing next to the inlet air area (cool area), which may cause dew condensation and dew drop.

DETAILED DESCRIPTION OF THE PREFERRED EMBODIMENTS

Now, a preferred embodiment of a built-in cooking device according to the present invention will be described with reference to the drawings. As illustrated in FIGS. 1 through 4, a cooking device body 1 built into a cabinet has formed in the interior thereof a heating chamber 3 for storing an object to be cooked. The object to be cooked is placed on a loading portion of a drawer body 2 capable of being drawn out of or stored into the heating chamber 3. The drawer body 2 is formed integrally with a door 2*a* capable of shutting a front side opening 3*a* of the heating chamber 3. Therefore, when the drawer body 2 is at a stored position within the heating chamber 3, the door 2*a* shuts the front side opening 3*a* of the heating chamber 3, and prevents microwave generated during the cooking operation from leaking to the exterior of the heating chamber. The drawer body 2 is guided in sliding motion with respect to the cooking device body 1 via a slide mechanism (not shown) disposed on the outer side of the heating chamber 3, which can be provided with a driving means such as an electric motor for automatically opening and closing the door, or for assisting the manual opening and closing operation of the door.

Figure 1:
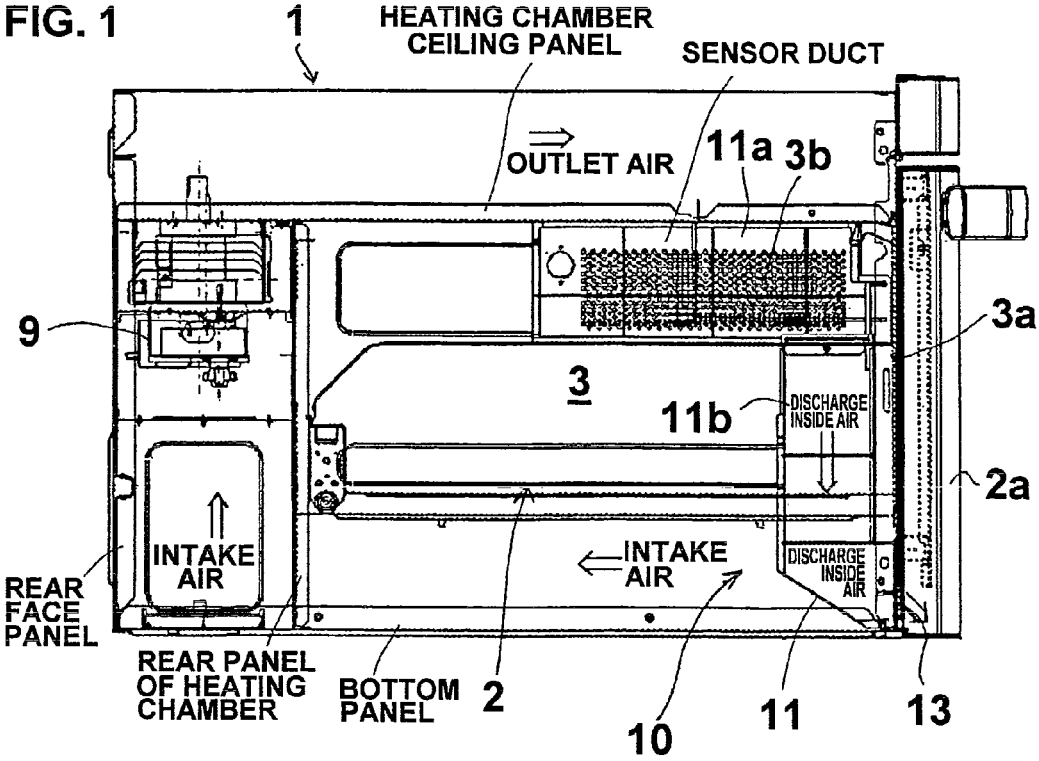
FIG. 1 is a schematic cross-sectional side view of a built-in cooking device according to the present invention.
Figure 2:
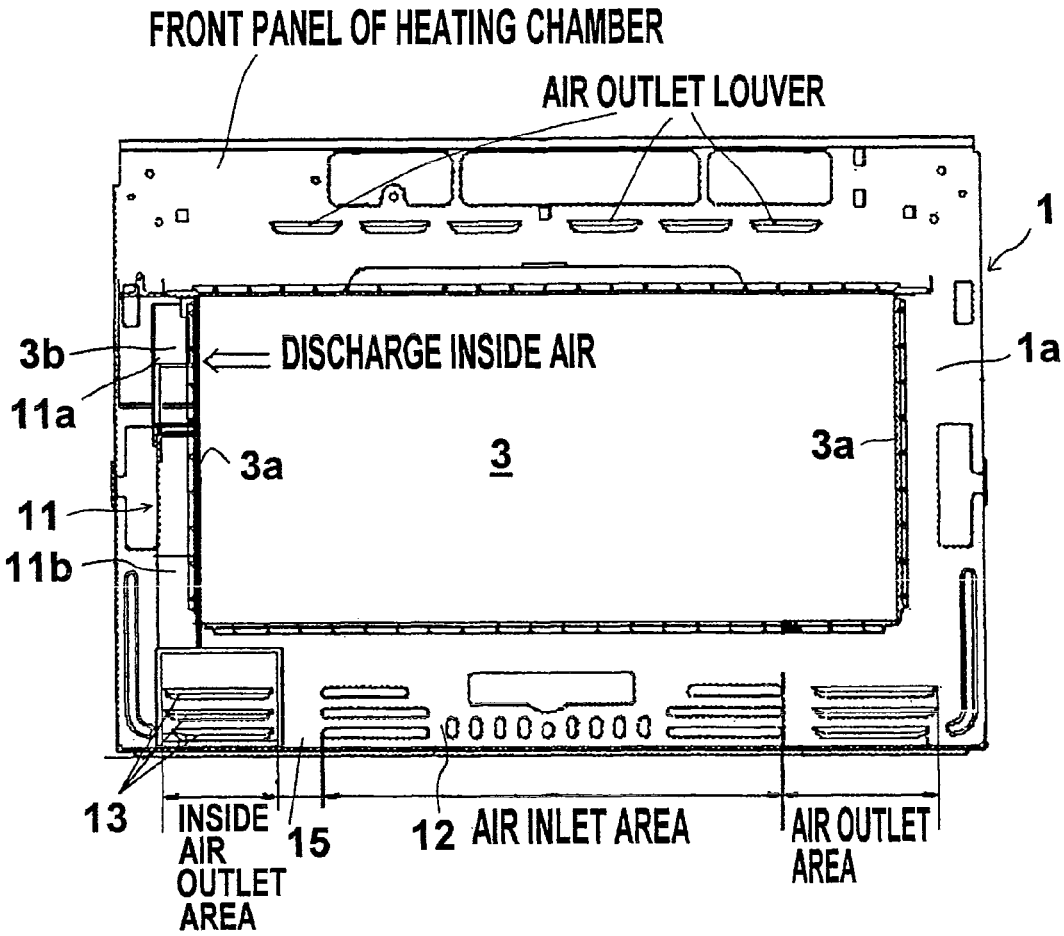
FIG. 2 is a front view of the cooking device body showing the state where a door is removed from the built-in cooking device shown in FIG. 1.
Figure 3:
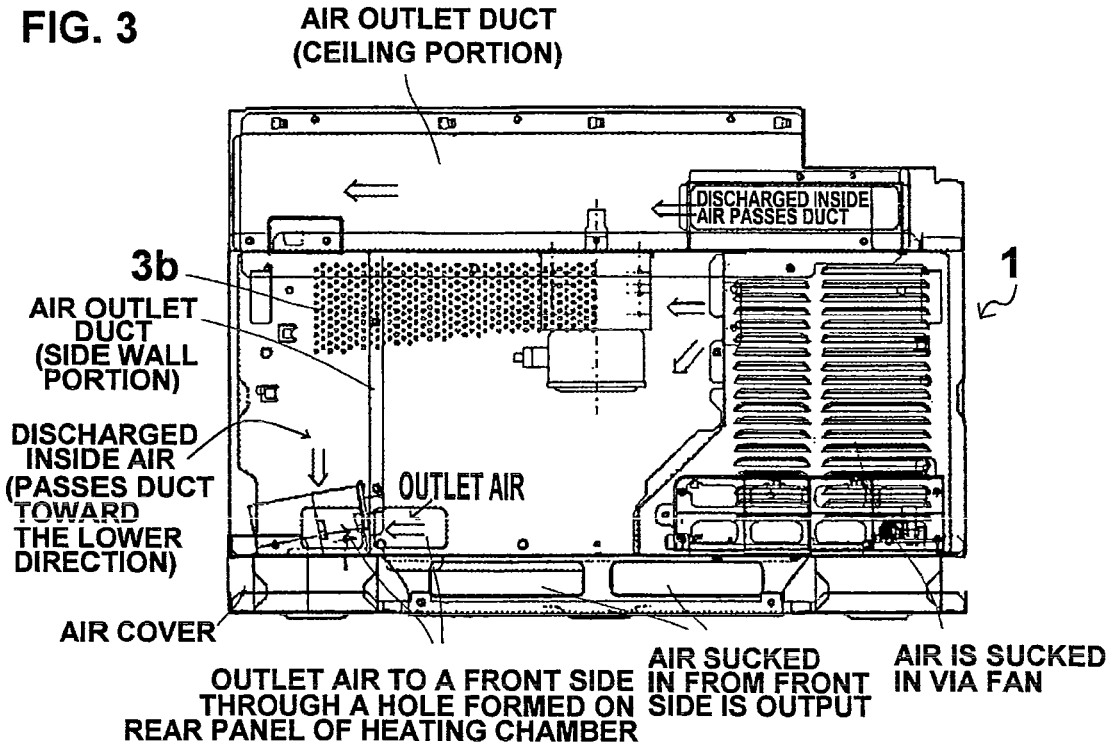
FIG. 3 is a rear view of the built-in cooking device shown in FIG. 1.
Figure 4:
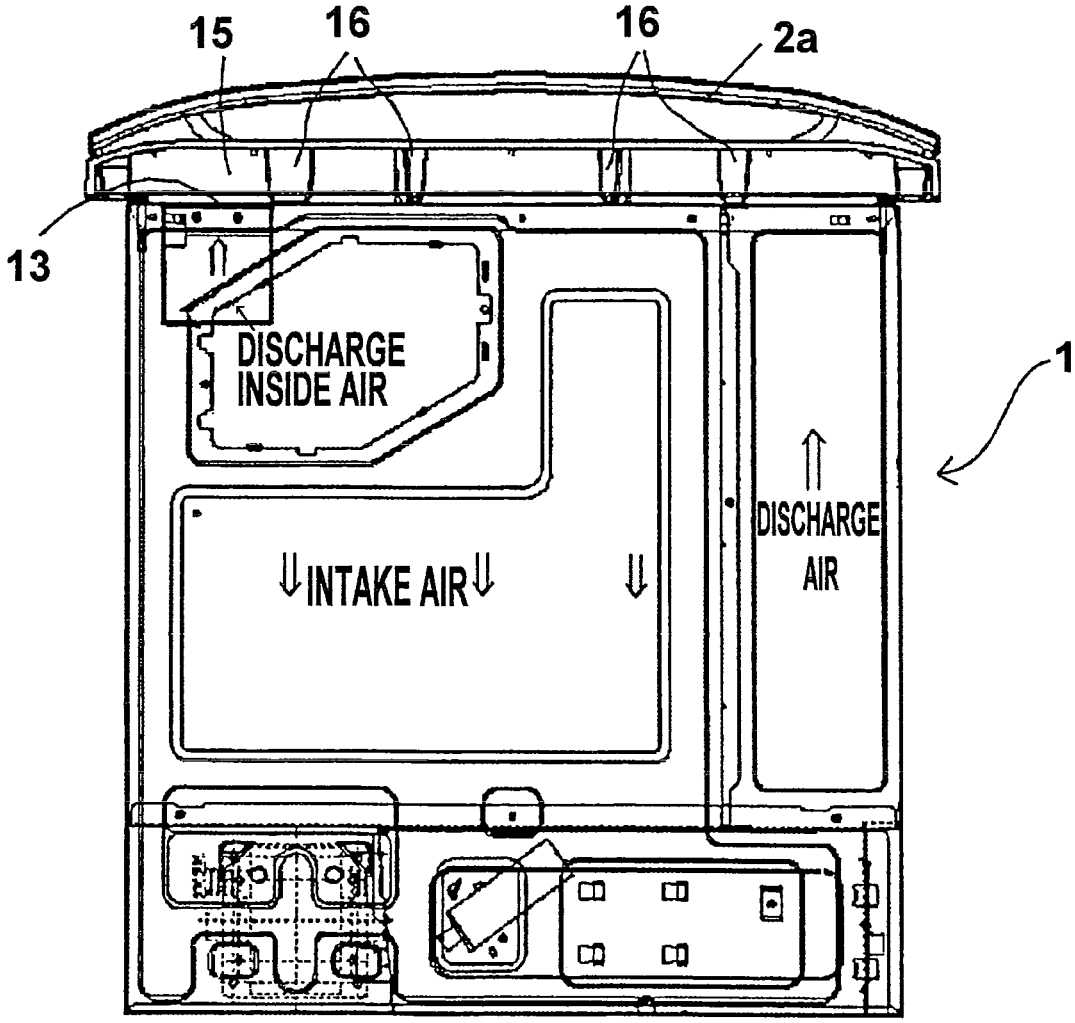
FIG. 4 is a bottom view of the built-in cooking device shown in FIG. 1.
Figure 5:
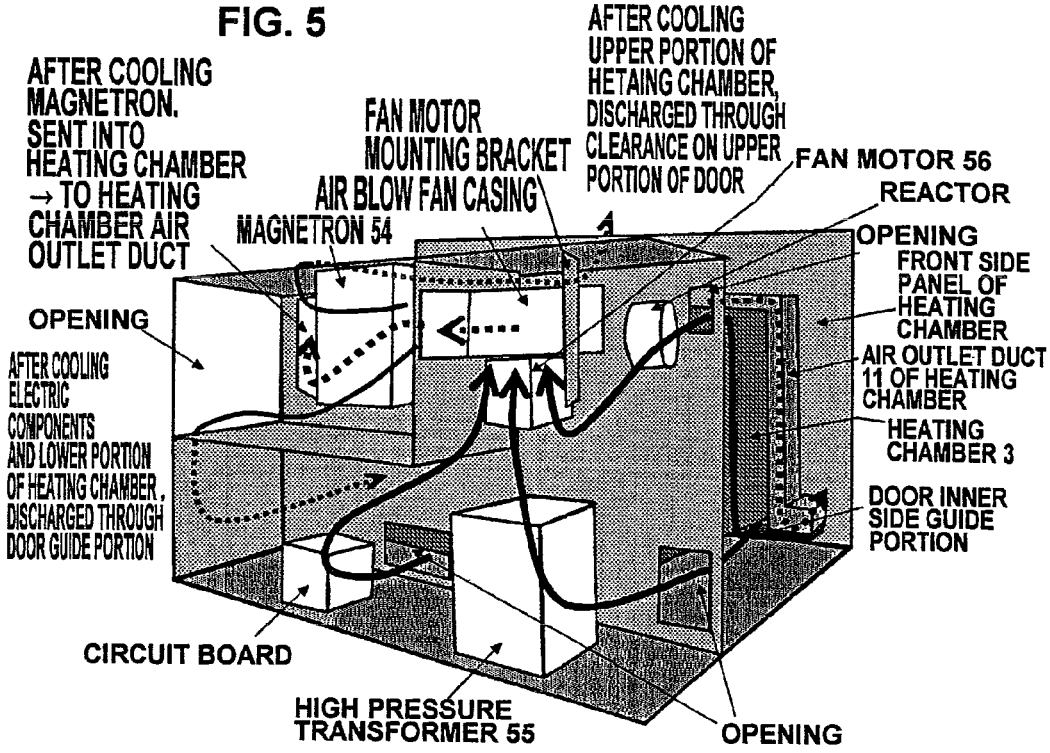
FIG. 5 is a concept view of an air outlet structure of the built-in cooking device shown in FIG. 1.
Figure 6A:
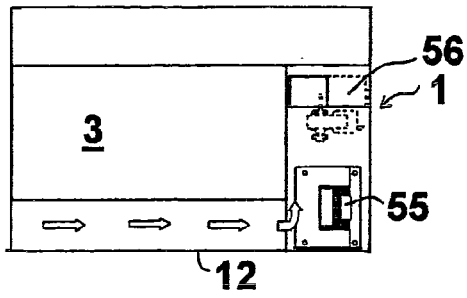
FIG. 6A is a view showing the arrangement of electric components at a depth portion of the built-in cooking device shown in FIG. 1.
Figure 6B:
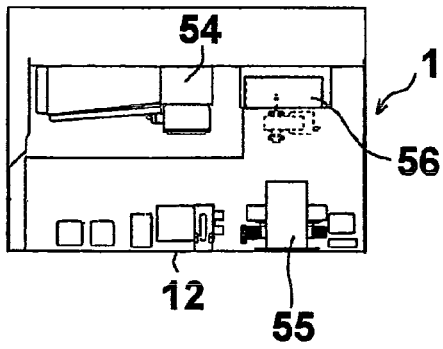
FIG. 6B is a view showing the arrangement of electric components at a depth portion of the built-in cooking device shown in FIG. 1.
Figure 9:
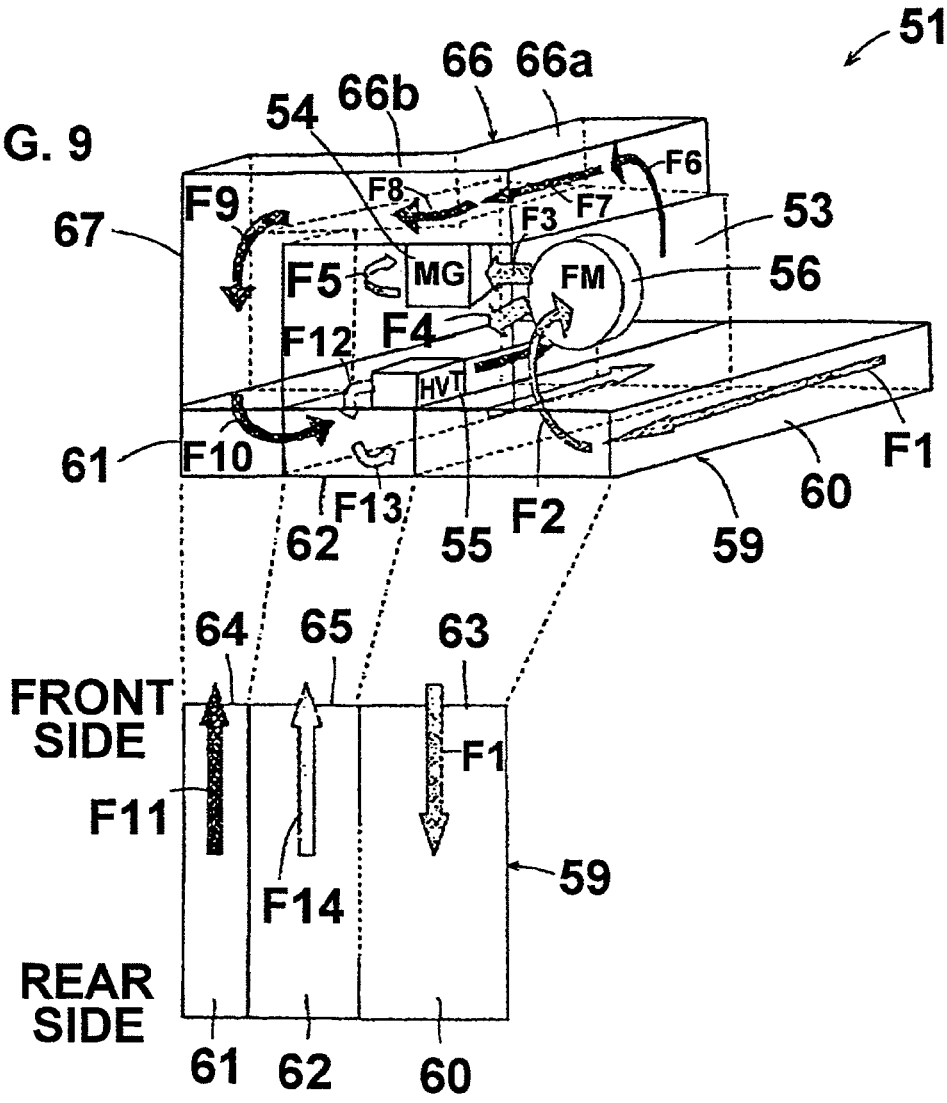
Prior Art FIG. 9
FIG. 9 is a concept view of an air outlet structure of the built-in cooking device according to the prior art.
Figure 10A:
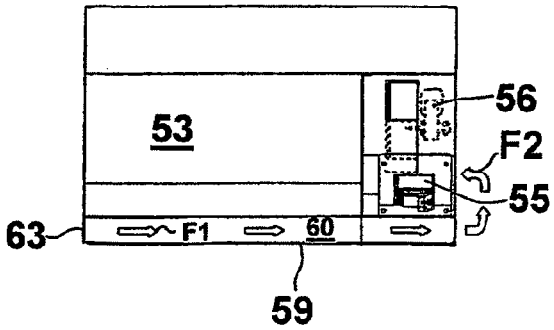
Prior Art FIG. 10A
FIG. 10A is a view showing the arrangement of electric components at a depth portion of the built-in cooking device according to the prior art.
Figure 10B:
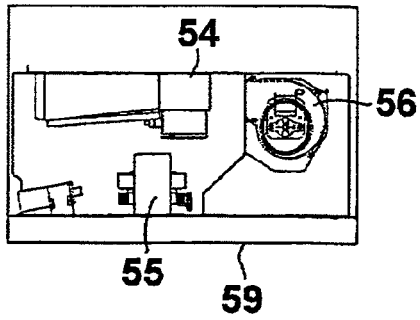
Prior Art FIG. 10B
FIG. 10B is a view showing the arrangement of electric components at a depth portion of the built-in cooking device according to the prior art.

FIG. 5 shows a conceptual view of an air outlet structure of the built-in cooking device. Further, FIGS. 6A and 6B show the arrangement of electric components at the depth portion of the built-in cooking device. The components equivalent to those in the prior art air outlet structure illustrated in FIG. 9 are denoted with the same reference numbers, and detailed descriptions thereof are omitted. The present conceptual view illustrates how the air taken in from the exterior is sent into the heating chamber 3 through the operation of a fan motor 56. The air flowing in through the opening formed on a rear panel of the heating chamber 3 into the depth portion of the device cools the high pressure transformer 55 and the circuit board, and then is sucked through the fan motor 56. A portion of the air sent out from the fan motor 56 cools a magnetron 54, flows into the heating chamber 3, and thereafter, is discharged to the exterior through a heating chamber air outlet duct 11. Another air flow flows through a ceiling surface air outlet duct, cools the upper portion of the heating chamber 3 (the ceiling panel and the upper area thereof), and is discharged through a clearance formed above the door via a louver. The remaining air flow cools the electric components and the lower part of the heating chamber 3, and is discharged through a door guide portion.

Since the inside air within the heating chamber 3 contains heat and vapor generated during cooking of the object to be cooked, an air outlet portion 10 for discharging the inside air is disposed in the cooking device body 1. The discharge of inside air is performed by increasing the inside pressure within the heating chamber 3 by sending into the heating chamber 3 the air taken in by an air fan 9 via an air intake portion formed in the cooking device body 1, and thereby pushing out the inside air from the chamber. The air outlet portion 10 has an air outlet duct 11 connected to a side wall 3*a* of the heating chamber 3 and a lower side portion 12 of a front wall 1*a* of the cooking device body 1.

The air outlet duct 11 for discharging the inside air is a duct formed by utilizing the side wall 3*a* of the heating chamber 3, which is connected to the lower side area 12 of the front wall (front side panel) 1*a* of the cooking device body 1. The side wall (side face panel) 3*a* of the heating chamber 3 includes an air outlet port area 3*b* having a large number of outlet ports formed on the upper front side of the side wall 3*a*. The air outlet duct 11 is composed of a first duct portion 11*a* covering the outer side of the heating chamber 3 of the air outlet port area 3*b* and extending laterally, and a second duct portion 11*b* disposed along the outer side of the side wall 3*a* downward to the lower side portion 12 of the front wall 1*a* of the cooking device body 1.

Since the inside air within the heating chamber 3 has high temperature, the air tends to gather at the upper area. Therefore, the air inside the heating chamber 3 is discharged through the large number of air outlet ports formed in the air outlet port area 3*b* disposed on the upper front side of the side wall 3*a* into a first duct portion 11*a* of the air outlet duct 11, and the outlet air flow passes a second duct portion 11*b* and is discharged via an air outlet opening 13 formed to the lower side portion 12 of the front wall 1*a* of the cooking device body 1 to the exterior of the cooking device body. Therefore, the present arrangement does not require an air inlet and outlet duct structure composed of a thick duct disposed on the lower side of the heating chamber 3 as according to the prior art, so that the height of the heating chamber 3 can be increased.

An air outlet opening 13 of the air outlet duct 11 is formed on the lower side portion 12 of the front wall 1*a* of the cooking device body 1, and when the door 2*a* is stored to shut the front side opening 3*a* of the heating chamber 3, the air outlet opening 13 is hidden from the front side by the door 2*a*. As described, since the air outlet opening 13 of the air outlet duct 11 is hidden from the front side by the door 2*a* when the door 2*a* is closed, the air outlet that had been visible according to the prior art device is no longer visible from the front side, and the exterior design of the present built-in cooking device is advantageously simplified. When the door 2*a* is closed, the air outlet opening 13 is simply hidden but not closed, so that the outlet air flow will not be interfered.

The air outlet opening 13 of the air outlet duct 11 is disposed close to the left or right end in the width direction of the lower side portion 12 of the front wall 1*a* of the cooking device body 1. The flow of inside air within the heating chamber 3 is a flow headed toward the air outlet port area 3*b* disposed on one side wall 3*a*, so that the air outlet opening 13 of the air outlet duct 11 only needs to be disposed close to the width-direction-end on the side where the air outlet port area 3*b* is disposed.

Figure 7:
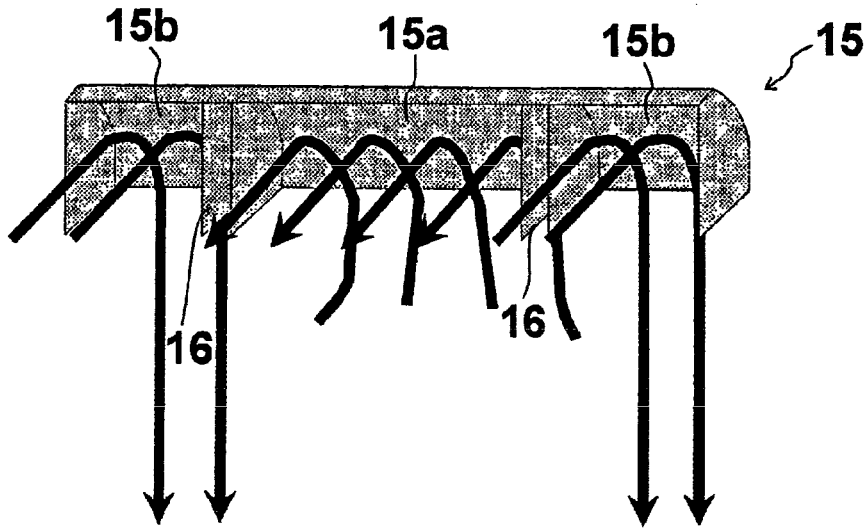
FIG. 7 is a concept view of air flow of the inlet and outlet air guide portion.

As shown in FIG. 7, it is possible to form on the inner side of the door 2*a* an air guide (air inlet and outlet) portion 15 formed with an angle of approximately 90 degrees toward the heating chamber and toward the lower side of the door on the lower end rim portion of the door 2*a* corresponding to the range of the air outlet opening 13 of the air outlet duct 11, so as to mutually bend the direction of air flows passing therethrough. By adopting a door frame having the lower end of the door formed as an air guide portion 15, it becomes possible to eliminate the air inlet and outlet louver (visible from the exterior) disposed on the lower front side of the prior art cooking device body, which not only leads to cut down the costs but also to improve the exterior design since the air inlet and outlet portion can be hidden from the eyes of the user and only the front side of the door becomes visible.

On the inner side of the door 2*a* are formed partition portions 16 for guiding the outlet air flow from the air outlet opening 13 of the air outlet duct 11 in correspondence to the left and right boundaries of the air outlet opening 13 of the air outlet duct 11. The partition portions 16 can be formed integrally, for example, when molding a resin product constituting the inner wall component of the door 2*a*. By forming partition portions 16, a portion of the lower area of the door 2*a* functions as an outlet air guide on the outer side of the chamber (air outlet portion 15*b*; refer to FIGS. 6A, 6B), and the air flow discharged through the air outlet opening 13 of the air outlet duct 11 is guided along the partition portions 16 desirably downward from the lower area of the front side of the door 2*a*. The downward outlet air flow blown down from the air outlet portion 15*b* will reach the area near the floor surface by wind speed, where the wind speed is lost and the air is dispersed horizontally, so that hot outlet air flow can be prevented from directly hitting the user's body from waist to knee.

As described, the left and right ends of the air guide portion 15 is an outlet air guide (air outlet portion 15*b*) communicated with the air outlet opening 13, but the center area of the air guide portion 15 is an intake air guide (air intake portion 15*a*) communicated with the air intake portion disposed on the cooking device body 1. According to the present arrangement, since the air relatively close to room temperature at a height close to the lower area of the door is taken in through the air intake guide, it becomes possible to prevent the outlet air flow reaching the floor surface and spreading horizontally from being sucked in directly and causing short circuit. In other words, outlet air is assumed to be sent out from the cooking device body 1 to the door 2*a* via the air blow fan, where the flow direction is biased downward via the air outlet portion 15*b*, so that the outlet air flows with a downward directional quality with a flow speed. The outlet air flow directed downward is a gas having a varied density since the temperature thereof differs from outer air, and since it has a downward directional quality, it reaches the floor as a continuous air flow without easily mixing with outer air. On the other hand, since the intake air does not have such directional quality regardless of speed, so that outer air close to the air outlet opening 13 is taken in. As described, since the air flows of the inlet and outlet air pass the air inlet and outlet portion 15 having the same shape, but since the flow paths of the inlet and outlet air are asymmetric, and the inlet and outlet air are discriminated hydrodynamically, a short circuit phenomenon at the air inlet and outlet portion 15 where the outlet air is directly sucked in again can be significantly reduced.

Figure 8:
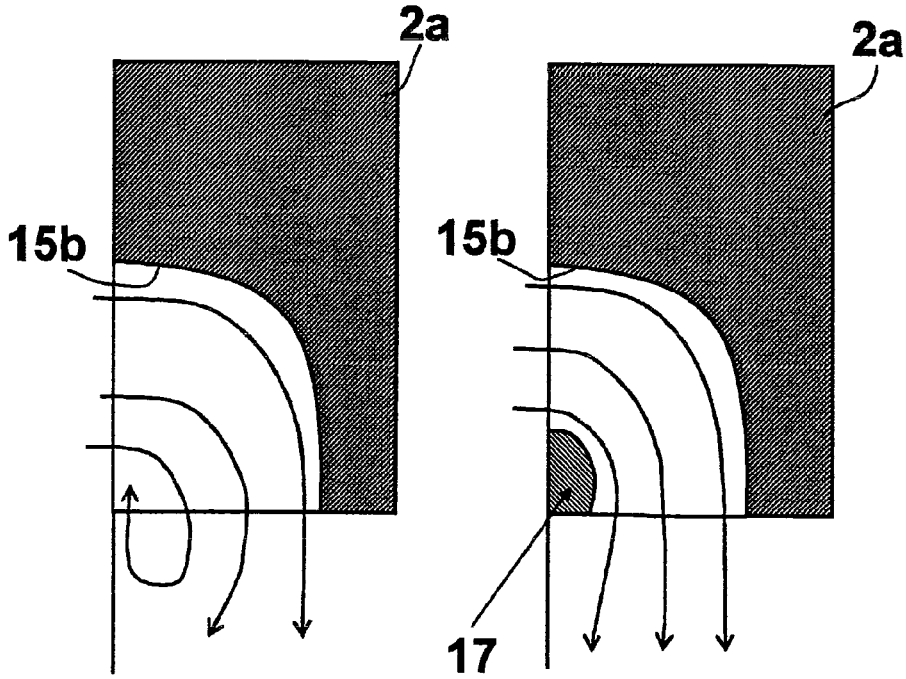
FIG. 8 is a cross-sectional view of the inlet and outlet air guide portion.

FIG. 8 is a cross-sectional view during cooking operation of the air outlet portion 15*b*. The outlet air flowing out from the upper portion of the air outlet opening 13 collides against the curved surface of the air outlet portion 15*b* and is biased downward, but the air flowing out from the lower portion of the air outlet opening 13 may be drawn toward the negative pressure portion generated at the lower area of the air outlet opening 13, turning into a vortex flow and losing its flow speed. In this case, the portion of the outlet air flow having turned into a vortex flow is retained at the lower area of the air outlet opening 13 and sucked in through the air inlet portion, causing short circuit and deteriorating the cooling effect of the cooking device. If such vortex flow is likely to occur, it is desirable to dispose a Coanda guide 17 which is an air flow guide having a curved surface with a positive curvature to the lower area of the air outlet opening 13, so as to bias the outlet air flowing out from the lower area of the air outlet opening 13 toward the lower direction via a Coanda effect, according to which the occurrence of a vortex flow can be prevented and the hydrodynamic discrimination of inlet air and outlet air can be further improved in a desirable manner.

By adopting the above-described arrangement, the present invention has enabled to eliminate the air inlet and outlet duct structure with a thick duct disposed below the heating chamber, so that the built-in cooking device according to the present invention is structured so that the interior structural body such as the heating chamber is engaged either directly or via an engagement means having high rigidity to a bottom face panel. This is effective in improving the mechanical strength of the built-in cooking device throughout the product delivery state from the production of the product in a factory and packaging to the built-in installation process.

In other words, the standards related to product design requires that the interior of the device is not damaged when the device is dropped in the packaged state, assuming a case where the device is dropped from the back of a truck to a road surface during transportation, but according to the prior art cooking device having an inlet and outlet duct structure with a thick duct disposed on the bottom side of the heating chamber 3, the air inlet and outlet structure may be deformed by the shock caused by the drop, so that it was necessary to adopt a duct structure capable of enduring a stress significantly greater than the stress applied during actual use, according to which both the cost and the weight of the device was increased.

Furthermore, even if the stress applied to the air inlet and outlet duct structure during the drop test was within the elastic limit of the steel panels constituting the air inlet and outlet duct, and that plastic deformation does not occur since the duct is deformed temporarily but restores its original shape by repulsion, a stress in the opposite direction as the stress applied during the drop test of a normal cooking device is applied during the repulsive restoration. Therefore, it is necessary to consider such stress in the opposite direction when designing the portions adjacent to the air inlet and outlet duct structure, and for example, the methods and positions for mounting weight members such as the high pressure transformer had been restricted according to the prior art. On the other hand, according to the structure disclosed in the preferred embodiment of the present invention, the inner structural body such as the heating chamber is engaged either directly or via an engagement means having a high rigidity to the bottom face panel, so that there is no need to consider the above-described stress applied in the opposite direction during repulsive restoration, and the costs of the relevant portions could be cut down.

As described, according to the structure disclosed in the preferred embodiment of the present invention, it is possible not only possible to solve the design problems according to the prior art built-in cooking device caused by having an air inlet and outlet duct structure with a thick duct disposed on the lower side of the heating chamber, and to realize the reduction of product costs and weight, but also to realize an indirect design improvement effect due to the improvement of the method and the position for mounting the heavy weight component in the interior of the device.

What is claimed is:

1. A built-in cooking device comprising:

a cooking device body built into a cabinet and having in an interior thereof a heating chamber capable of storing an object to be cooked;

a door capable of closing a front side opening of the heating chamber and comprising a partition portion provided on the inner side of the door;

an air inlet portion communicated with a lower side portion of a front wall of the cooking device body for taking in outside air to supply air that cools electric components and sending said air into the heating chamber; and an air outlet portion for discharging the air from the heating chamber containing heat and vapor generated during cooking of the object to be cooked;

wherein the air outlet portion has an air outlet duct connected to a side wall of the heating chamber and the lower side portion of the front wall of the cooking device body, the air inlet portion is provided at an inner side of the door adjacent to the air outlet portion, the air inlet portion is provided at a center on the lower side portion of the front wall and the air outlet portion is provided at both sides on the lower side portion of the front wall, at positions lower than the bottom portion of the heating chamber, such that the air inlet portion and the air outlet portion are divided in a vertical direction, and the partition portion is provided so as to separate a boundary of the air inlet portion and air outlet portion in the vertical direction.

2. The built-in cooking device according to claim 1, wherein the side wall of the heating chamber has an air outlet port area in which a large number of air outlet ports are provided at an upper front portion of the side wall; and the air outlet duct extends from an outer surface side of the air outlet port area along an outer surface of the side wall to the lower side portion of the front wall of the cooking device body.

3. The built-in cooking device according to claim 1, wherein an air outlet opening of the air outlet duct is provided on the lower side portion of the front wall of the cooking device body, and the air outlet opening is hidden by the door when seeing the door from a front side thereof while the door is at a state closing a front opening of the heating chamber.

4. The built-in cooking device according to claim 3, wherein the air outlet opening of the air outlet duct is disposed close to a left or right end portion side in the width direction of the cooking device body.

5. The built-in cooking device according to claim 4, wherein the partition portion guides an outlet air flow from the air outlet opening of the air outlet duct corresponding to left and right boundaries of the air outlet opening of the air outlet duct.

6. The built-in cooking device according to claim 3, wherein an air outlet portion opening at a lower end edge of a door frame is provided on the inner side of the door in an area corresponding to the air outlet opening of the air outlet duct.

7. The built-in cooking device according to claim 2, wherein an air outlet opening of the air outlet duct is provided on the lower side portion of the front wall of the cooking device body, and the air outlet opening is hidden by the door when seeing the door from a front side thereof while the door is at a state closing a front opening of the heating chamber.

8. The built-in cooking device according to claim 1, wherein the cooking device comprises high-frequency generating elements to cook the contents of the heating chamber, said outside air taken into said air inlet portion cooling said high frequency generating elements.

9. The built-in cooking device according to claim 1, wherein a bottom surface of the air outlet duct descends gradually downwards such that air ejected from the air outlet is guided downwards so as to prevent a user from exposure to hot ejected air.

10. The built-in cooking device according to claim 1, wherein the electrical components are provided at a depth portion of the cooking device, and outside air is taken in from the bottom of a deep center of the heating chamber such that the outside air is guided to the electric components without the outside air being heated in the heating chamber, whereby cooling efficiency of the electric components is improved.

* * * * *

UNITED STATES PATENT AND TRADEMARK OFFICE

CERTIFICATE OF CORRECTION

PATENT NO. : 8,539,941 B2
APPLICATION NO. : 12/700239
DATED : September 24, 2013
INVENTOR(S) : Masayuki Iwamoto et al.

It is certified that error appears in the above-identified patent and that said Letters Patent is hereby corrected as shown below:

ON THE TITLE PAGE:

Insert the following as item (73), Assignee:

-- (73) Assignee: Sharp Kabushiki Kaisha, Osaka (JP) --.

Signed and Sealed this
Twenty-fifth Day of March, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,539,941 B2
APPLICATION NO. : 12/700239
DATED : September 24, 2013
INVENTOR(S) : Masayuki Iwamoto et al.

It is certified that error appears in the above-identified patent and that said Letters Patent is hereby corrected as shown below:

ON THE TITLE PAGE:

"item (76)" should read -- item (75) --.

Insert the following as item (73), Assignee:

-- (73) Assignee: Sharp Kabushiki Kaisha, Osaka (JP) --.

This certificate supersedes the Certificate of Correction issued March 25, 2014.

Signed and Sealed this
Twenty-second Day of April, 2014

Michelle K. Lee

Michelle K. Lee
*Deputy Director of the United States Patent and Trademark Office*